US006922967B2

(12) United States Patent
Collie

(10) Patent No.: US 6,922,967 B2
(45) Date of Patent: Aug. 2, 2005

(54) TORNADO AND HURRICANE ROOF TIE

(76) Inventor: Anthony D. Collie, P.O. Box AP-59004, New Providence (BS)

( * ) Notice: Subject to any disclaimer, the term of this patent is extended or adjusted under 35 U.S.C. 154(b) by 0 days.

(21) Appl. No.: 10/787,524

(22) Filed: Feb. 26, 2004

(65) Prior Publication Data

US 2004/0163355 A1 Aug. 26, 2004

Related U.S. Application Data

(63) Continuation-in-part of application No. 10/604,443, filed on Jul. 22, 2003, which is a continuation-in-part of application No. 10/211,138, filed on Aug. 2, 2002, now Pat. No. 6,837,019.

(51) Int. Cl.[7] ..... E04B 1/38

(52) U.S. Cl. ..... 52/656.9; 52/92.2; 52/712; 52/715

(58) Field of Search ..... 52/656.9, 712, 52/715, 713, 92.2, 93.1

(56) References Cited

U.S. PATENT DOCUMENTS

| | | | | | |
|---|---|---|---|---|---|
| 3,256,030 | A | | 6/1966 | Banse | |
| 4,449,335 | A | | 5/1984 | Fahey | |
| 4,498,801 | A | * | 2/1985 | Gilb | 403/232.1 |
| 4,527,375 | A | | 7/1985 | Braginetz | |
| 4,592,186 | A | * | 6/1986 | Braginetz | 52/699 |
| 4,714,372 | A | | 12/1987 | Commins | |
| 4,841,690 | A | | 6/1989 | Commins | |
| 4,932,173 | A | | 6/1990 | Commins | |
| 5,150,982 | A | | 9/1992 | Gilb | |
| 5,230,198 | A | | 7/1993 | Callies | |
| 5,303,520 | A | * | 4/1994 | Gozdziak | 52/92.2 |
| 5,481,844 | A | | 1/1996 | Kajita | |
| 5,488,810 | A | | 2/1996 | Horton | |
| 5,857,295 | A | | 1/1999 | Mikawa | |
| 6,295,781 | B1 | | 10/2001 | Thompson | |
| 6,519,908 | B1 | | 2/2003 | Masterson et al. | |
| 6,560,943 | B1 | | 5/2003 | Leek et al. | |
| 6,658,806 | B1 | | 12/2003 | Leek | |
| 6,807,790 | B2 | * | 10/2004 | Strickland et al. | 52/731.2 |
| 6,837,019 | B2 | * | 1/2005 | Collie | 52/712 |

* cited by examiner

*Primary Examiner*—Brian E. Glessner
*Assistant Examiner*—Basil Katcheves
(74) *Attorney, Agent, or Firm*—Whiteford, Taylor & Preston LLP; Jeffrey C. Maynard; Gregory M. Stone

(57) ABSTRACT

A building roof tie for attaching roof trusses and rafters to wood top plates in building structures, said roof tie having a sheet metal body with risers and a bridge for overlapping a rafter and flaps for wrapping on the sides of the top plate. The flaps may be configured to penetrate into the top plate for additional stability. Turnbuckles attached to the bridge provide additional hold-down strength against increased uplift forces. Such turnbuckles may include a hinge and pin assembly that can adjust up and down, forward and backwards. The roof ties are pitched to conform to a variety of framing applications. A plurality of apertures is formed in the roof tie to provide openings for fasteners for connecting the tie to the wood top plate and rafter.

15 Claims, 10 Drawing Sheets

TORNADO AND HURRICANE ROOF TIE

CROSS-REFERENCE TO RELATED APPLICATIONS

Related Application

This application is a continuation-in-part of co-pending and co-owned U.S. patent application Ser. No. 10/604,443, entitled "*Tornado and Hurricane Roof Tie*", filed with the U.S. Patent and Trademark Office on Jul. 22, 2003 by the inventor herein, which is a continuation-in-part of co-pending and co-owned U.S. patent application Ser. No. 10/211,138, entitled "*Tornado and Hurricane Roof Tie*", filed with the U.S. Patent and Trademark Office on Aug. 2, 2002 U.S. Pat. No. 6,837,019 by the inventor herein, the specifications of which are included herein by reference.

BACKGROUND OF THE INVENTION

1. Field of the Invention

This invention relates generally to building structures with wood roofs, and more particularly to structures exposed to extreme wind conditions, such as Tornadoes and Hurricanes, where building codes dictate that such structures be protected against structural failure to save lives of occupants. In particular, the present invention relates to a roof tie for anchoring a wood frame roof on a block construction building in order to resist uplift forces encountered during a high wind situation.

2. Background of the Prior Art

It is well known what high winds can do to a building, particularly to a wood frame construction low-rise structure. Generally, uplift forces tending to lift the roof off the structure or the entire structure off its foundation cause much of the damage sustained by the building.

Wood structures predominate in residential and light commercial construction, and when wood framing is employed, the structure must be protected from upward loads developed by high wind, which differs with geographical location and is enforced by different building codes for such areas. For example, the Bahamas and Florida, including the Florida Keys are situated in the pathway of the yearly Caribbean hurricane travel course and as such, encounter hurricanes and/or tornadoes from time to time. Houses in the Bahamas are typically constructed of cement block with a wooden top plate fastened to the top of cement block walls, for attaching a wooden roof. In the case of upward loads, the roof is generally tied to the walls using a variety of steel connectors that tie the top plate to the walls. The size and number of these steel connectors vary depending on the severity of the wind conditions in the locality of the building, and the building's geometry. Due to the house location in a susceptible high wind area, some building codes require that houses built with wooden roof support beams have a "Hurricane Tie" in place on every rafter.

"Hurricane Ties" are usually installed during the foundation and framing stages of construction. Carpenters and laborers hired by the framing contractor generally install connectors and sheathing. Correct size, location, and number of fasteners (nails or screws) are critical to sustaining the required load. Commonly, such laborers are inexperienced, which results in improper or inadequate installation. The connectors are usually installed during the framing stage due to related components being placed at the same time. This process slows the foundation and framing stages of construction, which, in turn, increases labor costs.

From the foregoing, it is apparent that there is a critical need for a strong roof tie system that provides for uplift loads, which system is cost effective and easy to install.

SUMMARY OF THE INVENTION

The present invention provides a solution to the above and other problems by reinforcing and anchoring the roof structure to the building top plate for a wood construction building, wherein a hold down force is applied to the ceiling rafters to counter the uplift and horizontal forces generated by high winds. The present invention can be incorporated during initial construction of a wooden roof structure.

It is an object of the present invention to provide a roof-tie bracket system for a wooden roof structure of a building that reinforces the roof against damage in a high wind situation, such as a hurricane.

It is another object of the present invention to provide a roof-tie bracket system for a wooden roof construction building that provides a downward force around the periphery of the roof, thereby to better resist upward lift imparted to the roof by high winds.

It is another object of the present invention to provide a roof-tie bracket system for a wood frame roof that provides reinforcement to the roof structure, thereby providing greater resistance to damage during high wind conditions. A related object is to increase public safety in structures existing in high wind susceptible areas.

It is yet another object of the present invention to enable cost effective construction of wooden roof structures while meeting all building code requirements. A related object is to provide a roof-tie bracket system for a low-rise building that complies with the recommendation of all major building codes.

This invention relates to a novel roof-tie bracket system for bracing a wood framed roof of a building, e.g., a residential dwelling, having a structure including a foundation upon which rests a wall construction and horizontal ceiling top plates. The structure is reinforced against the destructive forces of the atmosphere by high strength brackets preferably attached to every rafter where it joins the ceiling plates. The roof-tie bracket is connected to the structure by way of a plurality of fasteners, such as nails or screws.

The roof-tie bracket disclosed herein offers more body, more nailing surfaces, more wrapping capability, more strength, and more durability to the purchasing public. Such roof-tie brackets may be made from a graduated increase in sheet metal gauges in a variety of straps or ties to fit many framing applications and strength requirements. Moreover, such roof-tie brackets may be pre-pitched to a predetermined angle of a roof, keeping in mind the different sizes of wood that may be used to pitch a roof. Such roof-tie brackets create a solid attachment between a rafter and ceiling top plate. This simple invention enables a family of roof-tie brackets that can be mass-produced and sold for a reasonable price that, in fact, can be made or put in place by any skilled or semi-skilled person.

Some of the advantages of this invention include: increase in surface area of a roof-tie bracket, thereby creating more surfaces through which nails could penetrate the substructure; "prepitched" roof-tie brackets that create a snug fit over all substructures and angles, at angles consistent with industry roof pitch standards; a wide aperture that allows fastening of nails through the roof sheaths to the rafter beneath; "plate flaps" that further secures the roof-tie bracket to the top plate; and, in some embodiments, a "U-shaped ceiling joist structure" that provides further for the "strapping" of ceiling joists, all in one simple Hurricane and Tornado Tie.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
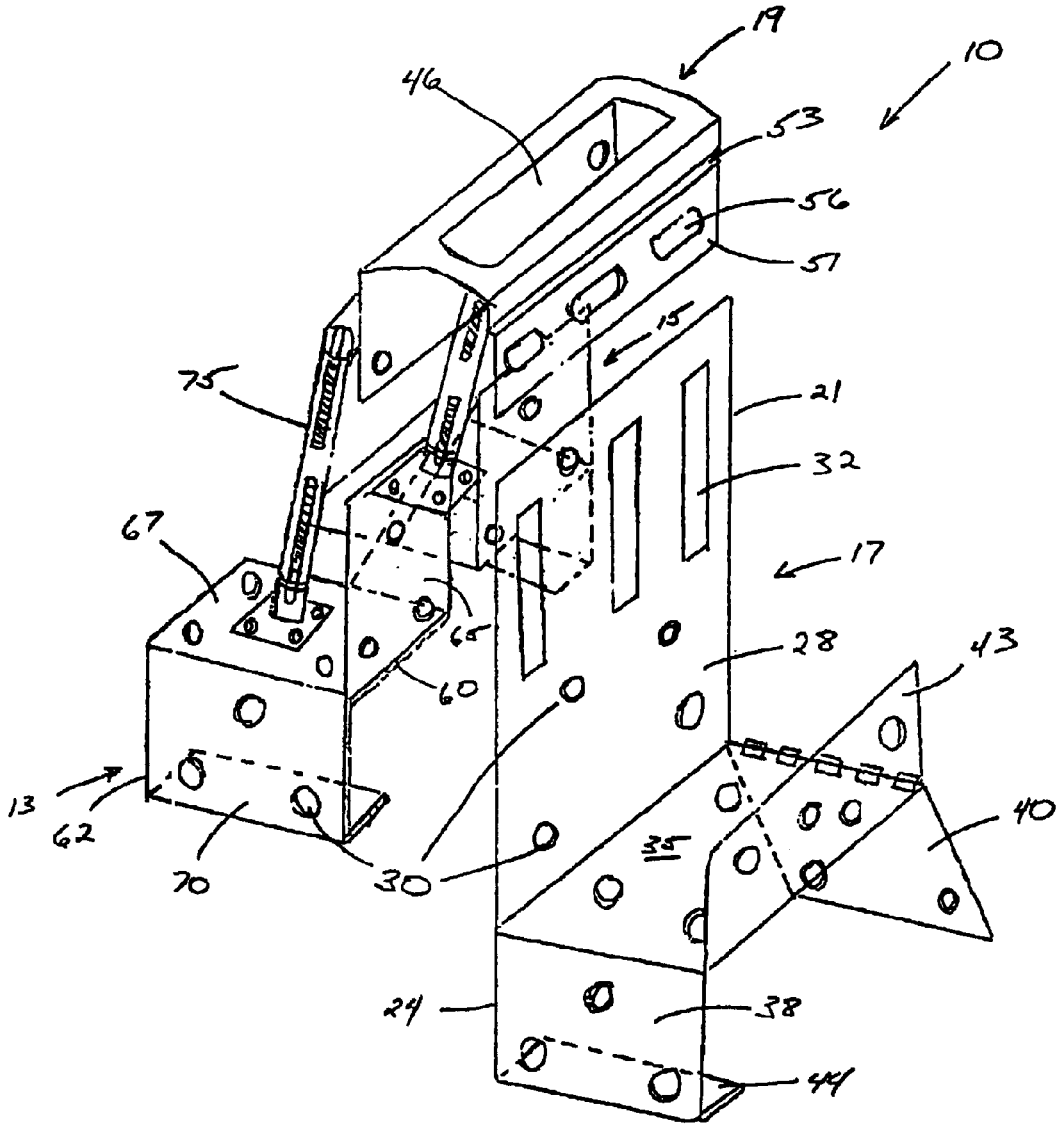
FIG. 1 shows an illustration of a roof tie in perspective, according to one embodiment of the present invention.
Figure 2:
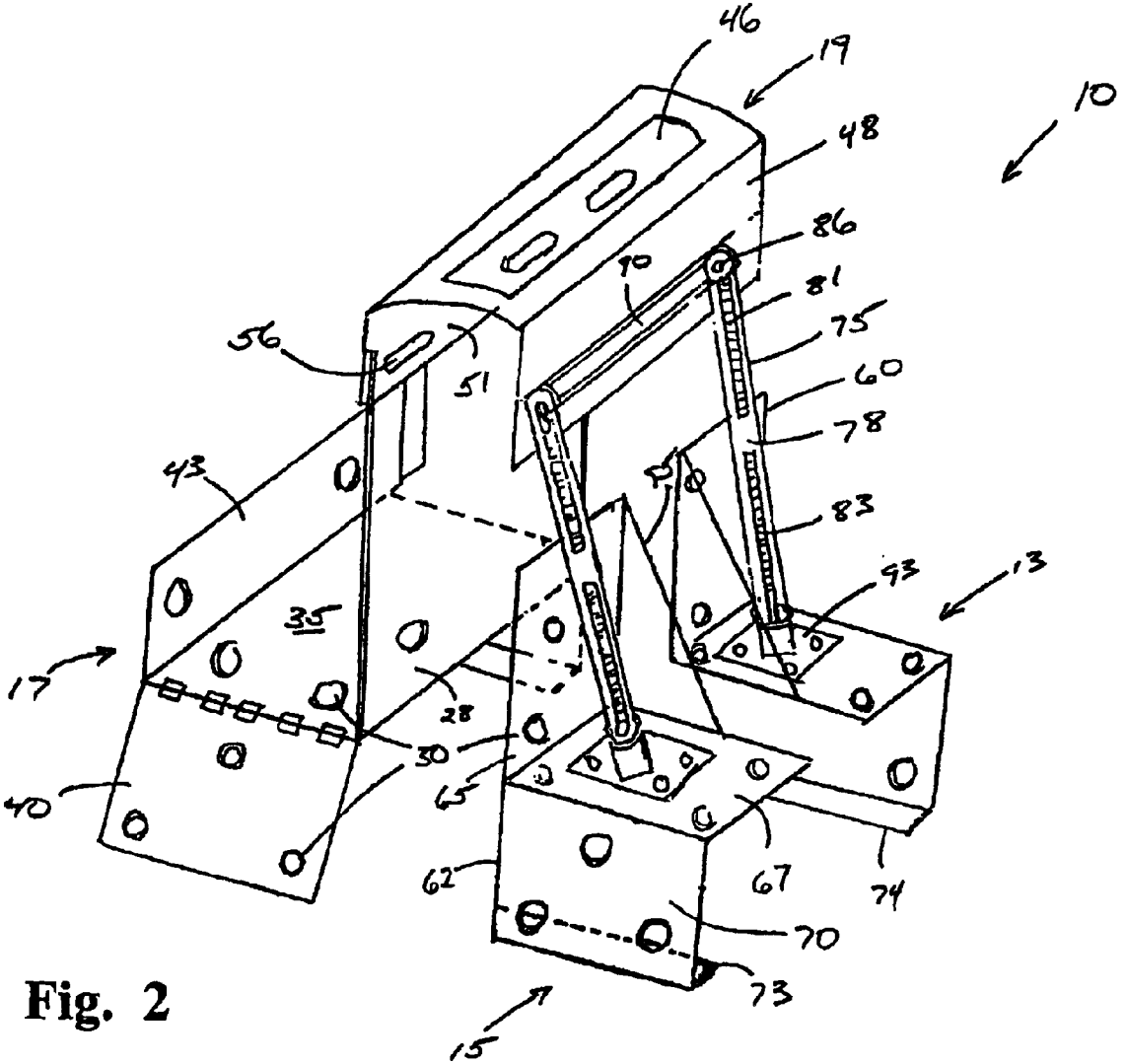
FIG. 2 shows an illustration of an alternate perspective of the roof tie of FIG. 1.

Referring to FIGS. 1 and 2, a roof tie according to the present invention, indicated generally as 10, is illustrated, comprising a pair of C-shaped tie components 13, 15, a U-shaped ceiling joist seat component 17, and a bridge component 19. The U-shaped ceiling joist seat component 17 has an upper portion 21 and a lower portion 24. The upper portion 21 of such U-shaped ceiling joist seat component 17 comprises a wall 28 having a plurality of apertures 30 and at least one fastener slot, such as 32. The lower portion 24 of such U-shaped ceiling joist seat component 17 comprises fastener extension 35, which extends at a right angle from wall 28 and further comprises fixed top plate flap 38, hinged top plate flap 40, and short wall 43. The fixed top plate flap 38 further comprises an appendage 44, described in further detail below. The short wall 43 is disposed on an outward edge of fastener extension 35 and extends upward, substantially perpendicular to such fastener extension 35. In general, the short wall 43 is preferably shorter than and substantially parallel to wall 28. A plurality of apertures 30 for inserting fasteners, such as nails, are disposed on such fastener extension 35, fixed top plate flap 38, hinged top plate flap 40, and short wall 43. Such plurality of apertures should be disposed in a staggered fashion to prevent splitting of the top plate and rafters when inserting such fasteners.

Bridge component 19 presents a wide aperture area 46 to permit fastening decking to a rafter. Such bridge component 19 should be wide enough to conform to the standard thickness of construction materials, such as wooden 2×4s. Bridge component 19 comprises a short riser 48 having a plurality of apertures 30 for fastening such bridge component 19 to a rafter. In some embodiments, bridge component 19 can be counter sunk into the rafter in order to be flush with the top surface of such rafter. Bridge component 19 further comprises an overlap plate 51 disposed away from such bridge component 19 by ledge 53 and having at least one opening, such as 56. In use, overlap plate 51 at least partly extends over wall 28. The fastener slots 32 are disposed on wall 28 such that, in use, fasteners inserted in openings 56 in overlap plate 51 can penetrate such fastener slots 32. By having such overlap, roof tie 10 can adapt to rafters of varying heights for application in a variety of construction scenarios. Fastener slots 32 enable fasteners to be inserted in such a manner to ensure a snug fit for bridge component 19 on the top of a rafter. Overlap plate 51 extends over wall 28, such that fasteners inserted in openings 56 also enter fastener slots 32 at a variable position depending on the height of the rafter, for attachment to the rafter.

Tie components 13, 15 present mirror images of each other. Each tie component 13, 15 has an upper portion 60 and a lower portion 62. The upper portion 60 of such tie component comprises a riser 65 having a plurality of apertures 30. The C-shaped lower portion 62 of such tie component comprises fastener extension 67, which extends at a right angle from riser 65 and further comprises a top plate flap 70 with an appendage 73. Appendage 73 extends inwardly at a right angle from top plate flap 70. Top plate flap 70 is sized and configured such that appendage 73 can fit under a top plate to form a three-sided wrap with fastener extension 67 and top plate flap 70. In some embodiments, top plate flap 70 is sized and configured such that appendage 73 may be embedded into a side of the top plate. In such an embodiment, appendage 73 should penetrate approximately ¾-inch into the wood top plate; the inner edge 74 of appendage 73 may be sharpened to enable such penetration. (Appendage 44 of the fixed top plate flap 38 of such U-shaped ceiling joist seat component 17 is configured in the same manner.) A plurality of apertures 30 for inserting fasteners, such as nails, are disposed on said fastener extension 67, and top plate flap 70.

Each tie component 13, 15 further comprises a turnbuckle 75 attached to bridge component 19 and fastener extension 67. Turnbuckle 75 comprises body 78 having a first threaded portion 81 extending out of the top of body 78 and a second threaded portion 83 extending out of the bottom of body 78. Body 78 is internally threaded for mating with such first and second threaded portions 81, 83. The distal end of such first threaded portion 81 terminates in an eye 86 having an opening for attaching to short riser 48 of bridge component 19. The eye 86 can be attached to short riser 48 by a suitable fastener, such as a nail or lag bolt. In some embodiments, short riser 48 presents a hook on which such eye 86 can be attached. In an additional embodiment, short riser 48 presents a track 90 in which an adjustable hook or other appropriate fastener can be variably positioned. The distal end of such second threaded portion 83 terminates in an eye or some other fashion for attachment to plate 93 attached to fastener extension 67 by suitable fasteners.

The alignment of the threads of such first and second threaded portions 81, 83 is configured such that rotation of body 78 in a first direction about its longitudinal axis causes both such first and second threaded portions 81, 83 to be drawn into body 78 and rotation of body 78 in a second, opposite direction about its longitudinal axis causes both such first and second threaded portions 81, 83 to be forced out of body 78. The roof tie 10 provides additional reinforcement against uplift forces encountered in a high wind condition, resulting in a sturdier, stronger tie. Such increased strength can be obtained at reduced cost by enabling use of lower galvanized steel gauges for its construction while providing increased hold-down force.

Bridge component 19 can be variably pitched and retrofitted to existing roof applications, especially for roof trusses. The turnbuckles can be adjusted, up or down, as necessary to provide sufficient hold down tension and to conform to the pitch of the roof.

For heavy-duty applications, or as an optional feature, roof tie 10 may further comprise a reinforcing wing 95 on tie components 13, 15. Such reinforcing wing 95 is generally triangular in shape and extends outward from riser 65 with the lower edge of reinforcing wing 95 attached to the inner edge of fastener extension 67. Such reinforced roof tie 10 provides vertical reinforcement to prevent balking while enabling increased rigidity to roof tie 10, resulting in a sturdier, stronger roof tie 10. The increased strength can be obtained at reduced cost by enabling use of lower galvanized steel gauges for its construction. Balking is caused by misalignment of trusses due to warping of roof timbers or loosening of fastened joints, resulting in roof decking being heaved up along such misaligned roof truss.

Figure 3:
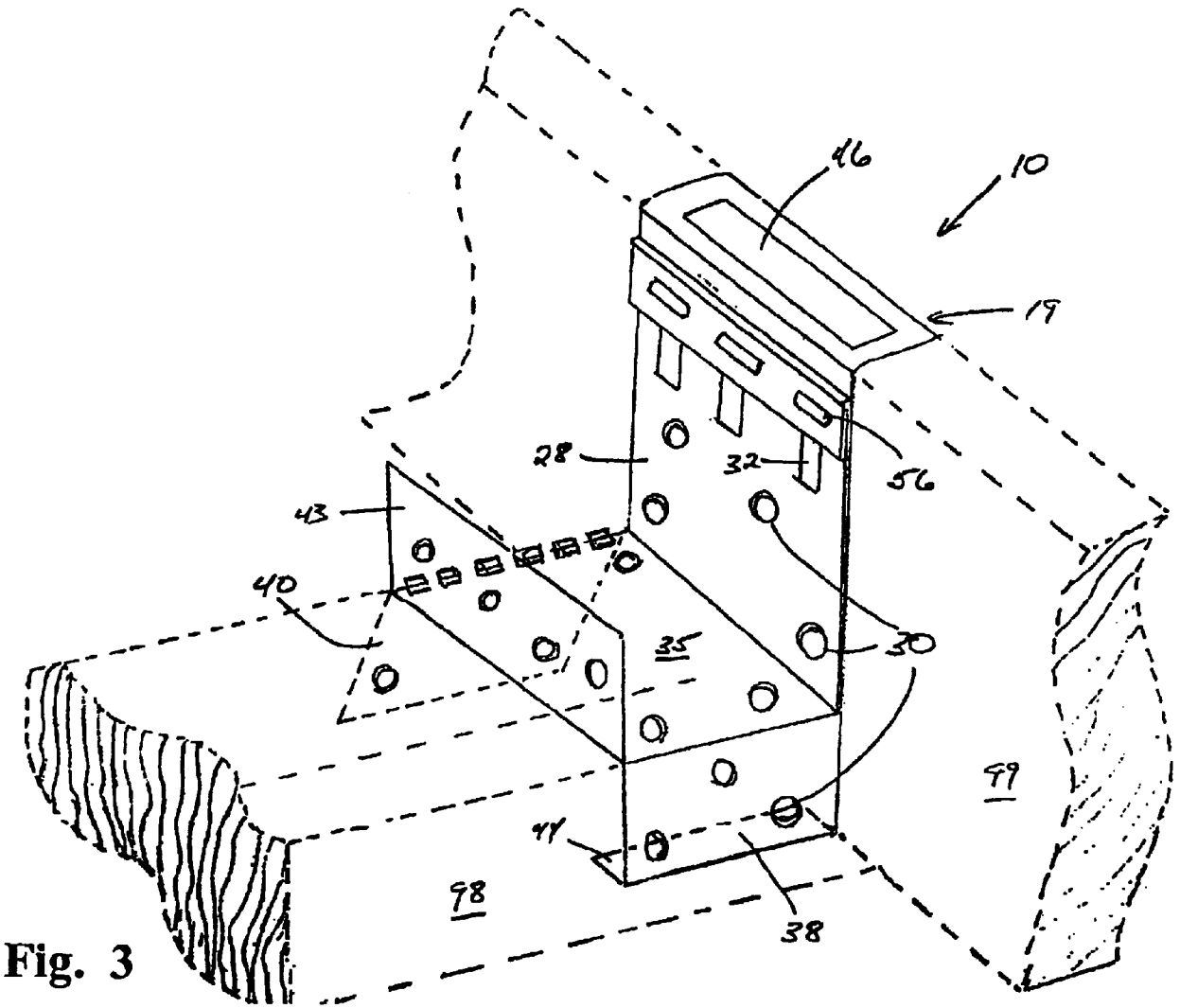
FIG. 3 shows an illustration of the roof tie in perspective, with top plate and rafter in phantom.
Figure 4:
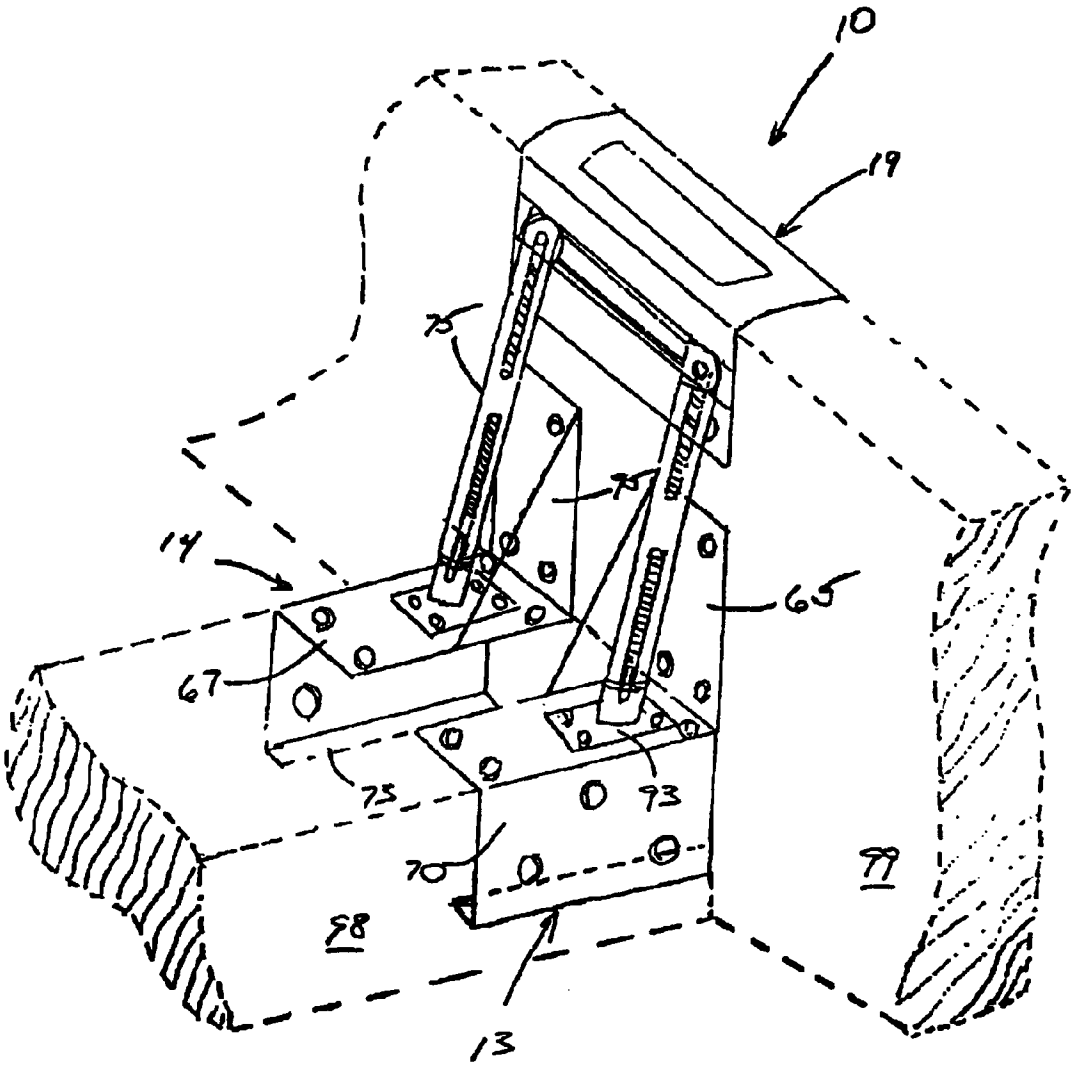
FIG. 4 shows an illustration of an alternate perspective of the roof tie of FIG. 3, with a top plate and rafter in phantom.

An application showing use of roof tie 10 is illustrated in FIGS. 3 and 4 presenting roof tie 10 in a position for fastening to top plate 98 and rafter 99. Fasteners are attached to top plate 98 and rafter 99 through apertures 30, and through openings 56 in alignment with fastener slots 32. Using a fastener in each aperture and opening ensures a strong and secure attachment. Additional embodiments using various numbers of holes can be used based on specific engineering requirements as determined by one skilled in the art.

As shown in FIG. 3, hinged top plate flap 40 can be rotated into approximately the same plane as fastener extension 35 to enable appendage 44 to be fastened into one side of top plate 98; then, hinged top plate flap 40 can be rotated substantially perpendicular to the fastener extension 35 providing a wrap around most of such top plate 98. Fixed top plate flap 38 and hinged top plate flap 40 are attached to top plate 98 with a plurality of suitable fasteners through apertures 30. Bridge component 19 straddles rafter 99 and is attached to rafter 99 with a plurality of fasteners, as described above. Wide aperture area 46 is provided to enable fastening of decking material to rafter 99.

As shown in FIG. 4, tie components 13, 15 are attached to top plate 98 to enable appendage 73 to be fastened into each side of top plate 98. Turnbuckle 75 is attached to bridge component 19. Fastener extension 35 and top plate flap 70 are attached to top plate 98 with a plurality of suitable fasteners through apertures 30. If necessary, turnbuckle 75 can be adjusted to provide sufficient hold down tension.

In some embodiments, the length of the forward edge of wall 28 may be longer than the rear edge of wall 28 in order to have bridge component 19 angled to correspond to a selected pitch for a roof. In such cases, the turnbuckles 75 of tie components 13, 15 can be adjusted to appropriate lengths to conform to the pitch of the roof.

Figure 5:
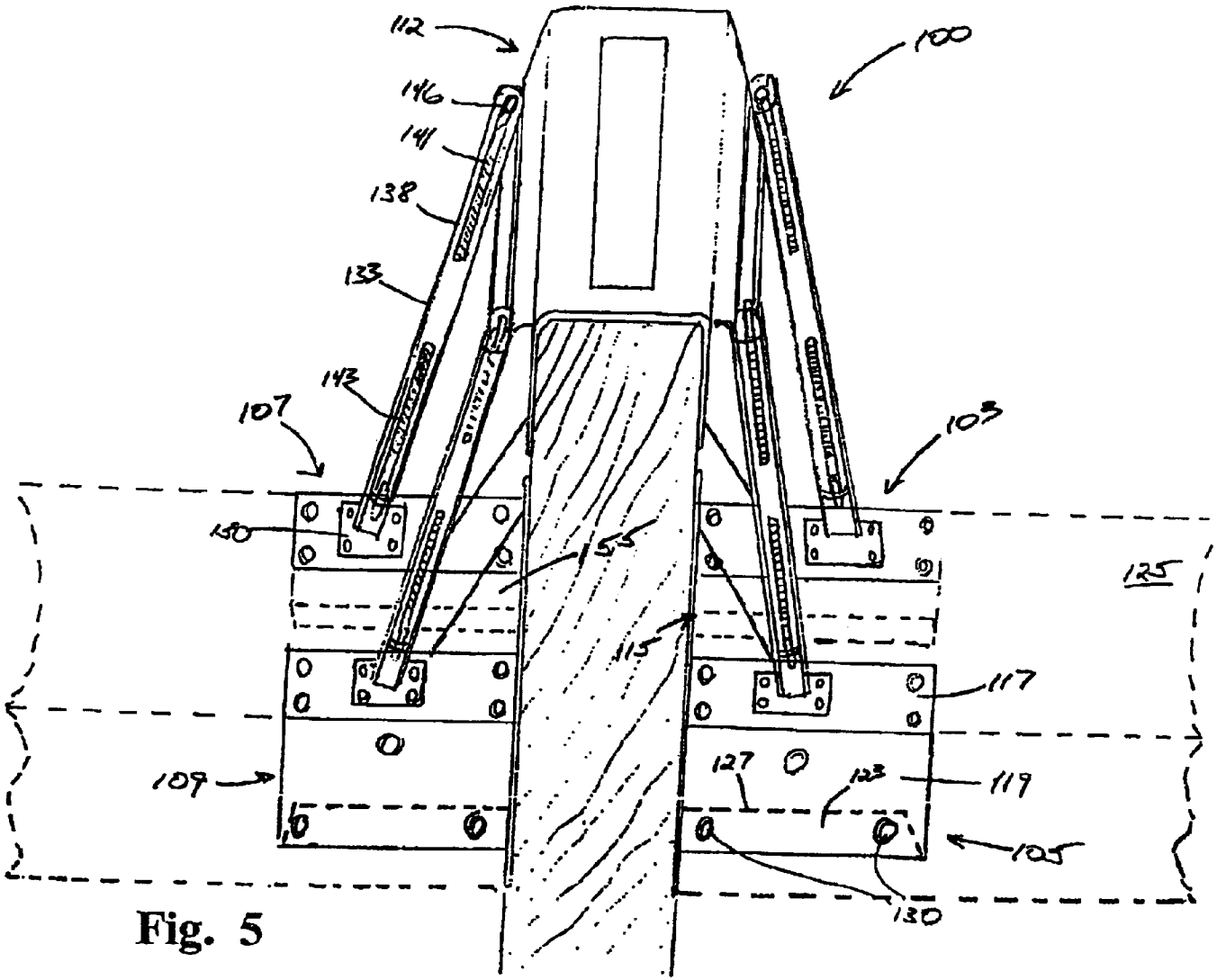
FIG. 5 shows an illustration of a roof tie, according to an alternative embodiment of the present invention.

FIG. 5 shows an illustration of an application according to an alternative roof tie embodiment. Roof tie 100 comprises two pair of matching tie components 103, 105, 107, 109 attached to either side of bridge component 112. Each tie component 103, 105, 107, 109 comprises a riser 115 having a plurality of apertures for inserting fasteners, such as nails therethrough and a fastener extension 117, which extends at a right angle from riser 115 and further comprises a top plate flap 119 with an appendage 123. Appendage 123 extends inwardly at a right angle from top plate flap 119. Top plate flap 119 is sized and configured such that appendage 123 can fit under top plate 125 to form a three-sided wrap with fastener extension 117 and top plate flap 119. In some embodiments, top plate flap 119 is sized and configured such that appendage 123 may be embedded into a side of the top plate 125. In such an embodiment, the inner edge 127 of appendage 123 may be sharpened to enable penetration into wooden top plate 125. A plurality of apertures 130 for inserting fasteners, such as nails are disposed on fastener extension 117 and top plate flap 119.

Each tie component 103, 105, 107, 109 further comprises a turnbuckle 133 attached to bridge component 112 and fastener extension 117. Turnbuckle 133 comprises a body 138 having a first threaded portion 141 extending out of the top of body 138 and a second threaded portion 143 extending out of the bottom of body 138. Body 138 is internally threaded for mating with such first and second threaded portions 141, 143. The distal end of such first threaded portion 141 terminates in an eye 146 having an opening for attaching to bridge component 112. The eye 146 can be attached to bridge component 112 by a suitable fastener, such as a nail or lag bolt. The distal end of such second threaded portion 143 terminates in an eye or some other fashion for attachment to plate 150 attached to fastener extension 117 by suitable fasteners.

The alignment of the threads of such first and second threaded portions 141, 143 is configured such that rotation of said body 138 in a first direction about its longitudinal axis causes both such first and second threaded portions 141, 143 to be drawn into body 138 and rotation of body 138 in a second, opposite direction about its longitudinal axis causes both such first and second threaded portions 141, 143 to be forced out of body 138. Each turnbuckle 133 on tie components 103, 105, 107, 109 is separately adjustable. Such roof tie 100 provides additional reinforcement against uplift forces encountered in a high wind condition, resulting in a sturdier, stronger tie. The increased strength can be obtained at reduced cost by enabling use of lower galvanized steel gauges for its construction while providing increased hold-down force.

For heavy-duty applications, or as an optional feature, roof tie 100 may further comprise a reinforcing wing 155 on tie components 103, 105, 107, 109. The reinforcing wing 155 is generally triangular in shape and extends outward from riser 115 with the lower edge of reinforcing wing 155 attached to an edge of fastener extension 117. Such reinforced roof tie 100 provides vertical reinforcement to prevent balking while enabling increased rigidity to roof tie 100, resulting in a sturdier, stronger roof tie 100. The increased strength can be obtained at reduced cost by enabling use of lower galvanized steel gauges for its construction. Balking is caused by misalignment of trusses due to warping of roof timbers or loosening of fastened joints, resulting in roof decking being heaved up along such misaligned roof truss.

Referring to FIGS. 6–9, an adjustable roof tie 200 is shown. Roof tie 200 comprises a pair of C-shaped tie components 205, 207, of similar construction as described with reference to FIGS. 1 and 2, a bridge component 210, also of similar construction as described with reference to FIGS. 1 and 2, and a U-shaped ceiling joist seat component 213. The U-shaped ceiling joist seat component 213 comprises two slidably engaged connector sections 217, 219, each having an upper portion and a lower portion. The upper portion 221 of connector section 217 comprises a wall 224 having a plurality of apertures. The lower portion 226 of connector section 217 comprises fastener extension 229, which extends at a right angle from wall 224 and further comprises top plate flap 231. The top plate flap 231 further comprises an appendage 235 that extends inwardly at a right angle from top plate flap 231. Top plate flap 231 is sized and configured such that appendage 235 can fit under a top plate to form a three-sided wrap with fastener extension 229 and top plate flap 231. In some embodiments, top plate flap 231 is sized and configured such that appendage 235 may be embedded into a side of the top plate. In such an embodiment, appendage 235 should penetrate approximately ¾-inch into the wood top plate; the inner edge 236 of appendage 235 may be sharpened to enable such penetration. At least one slot, such as 240, is disposed in fastener extension 229.

Figure 8:
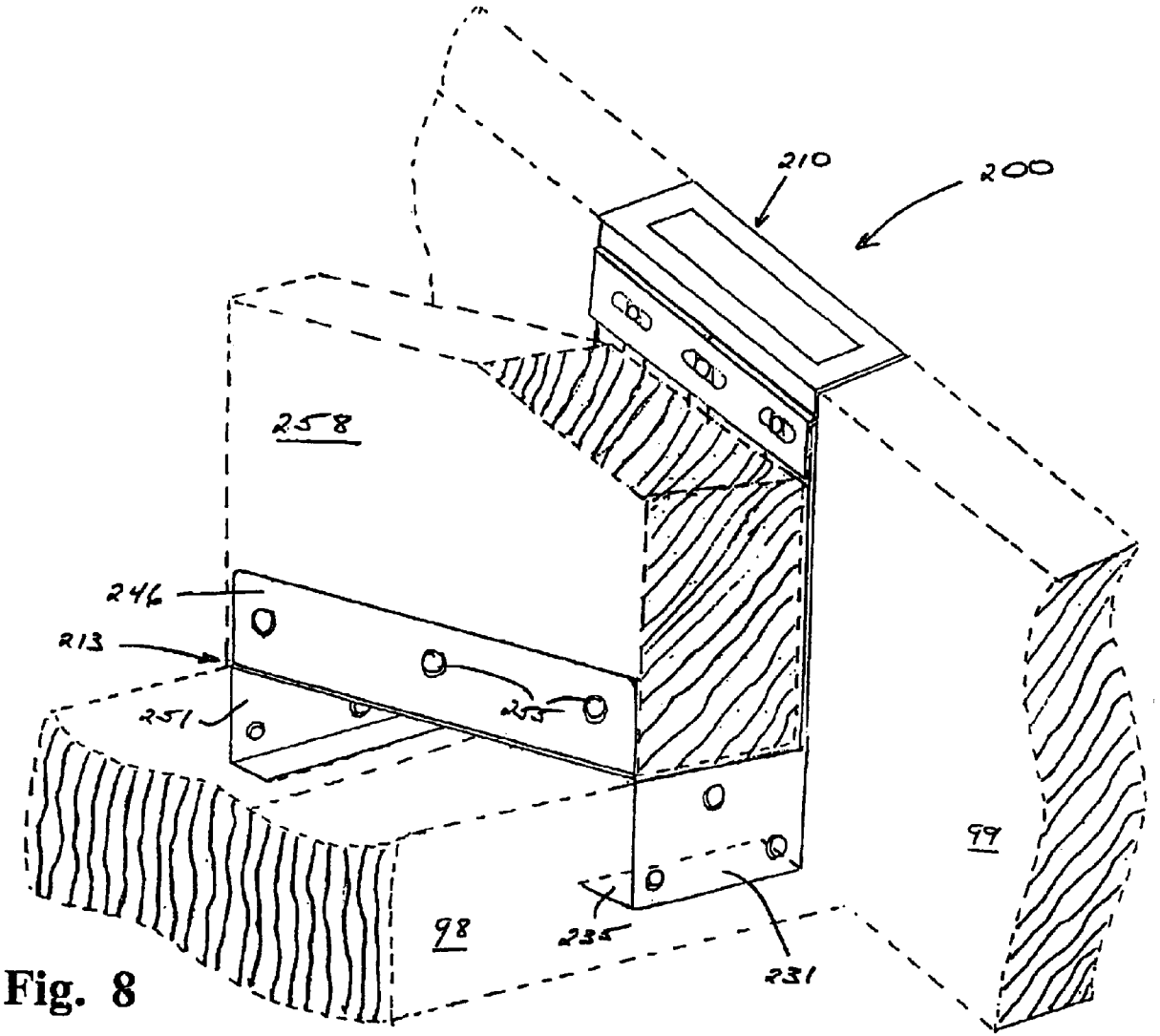
FIG. 8 shows an illustration of the roof tie of FIG. 7, in perspective, showing a ceiling joist in place.

Connector section 219 comprises fastener extension 243 having a short wall 246 disposed on an outward edge of fastener extension 243, which extends upward, substantially perpendicular to such fastener extension 243. The lower portion 248 of connector section 219 further comprises top plate flap 251. The top plate flap 251 is configured similar to top plate flap 231 and comprises an appendage that extends inwardly at a right angle from top plate flap 251. Top plate flap 251 is sized and configured such that the appendage can fit under a top plate to form a three-sided wrap with fastener extension 243 and top plate flap 231. In some embodiments, top plate flap 251 is sized and configured such that the appendage may be embedded into a side of the top plate. In such an embodiment, the appendage should penetrate approximately ¾-inch into the wood top plate; the inner edge of the appendage may be sharpened to enable such penetration. Fastener extension 243 overlaps fastener extension 229. A plurality of apertures 255 for inserting fasteners, such as nails, are disposed on such fastener extension 243, top plate flaps 231, 251, and short wall 246. Such plurality of apertures should be disposed in a staggered fashion to prevent splitting of the top plate and rafters when inserting such fasteners. Some apertures 255 disposed in fastener extension 243 should align with the at least one slot 240 disposed in fastener extension 229. By having such overlap, roof tie 200 can adapt to top plates of varying widths for application in a variety of construction scenarios. Fastener slot 240 enable fasteners to be inserted in such a manner to ensure a snug fit for U-shaped ceiling joist seat component 213 on the top plate. Fastener extension 243 extends over fastener extension 229, such that some fasteners inserted in apertures 255 also enter fastener slots 240 at a variable position depending on the width of the top plate, for attachment to the top plate. When roof tie 200 is attached to top plate 98 and rafter 99, a ceiling joist 258 can be set in the U-shaped ceiling joist seat component 213, as shown in FIG. 8. Fasteners, such as nails or screws can be inserted through apertures 255 to attach roof tie 200 to the ceiling joist 258.

In some embodiments, both the wall 224 and the short wall 246 may be attached to the same fastener extension, such that the remaining slidably engaged connector section comprises only the fastener extension, top plate flap, and the appendage, for adjustable fit on a top plate.

Figure 9:
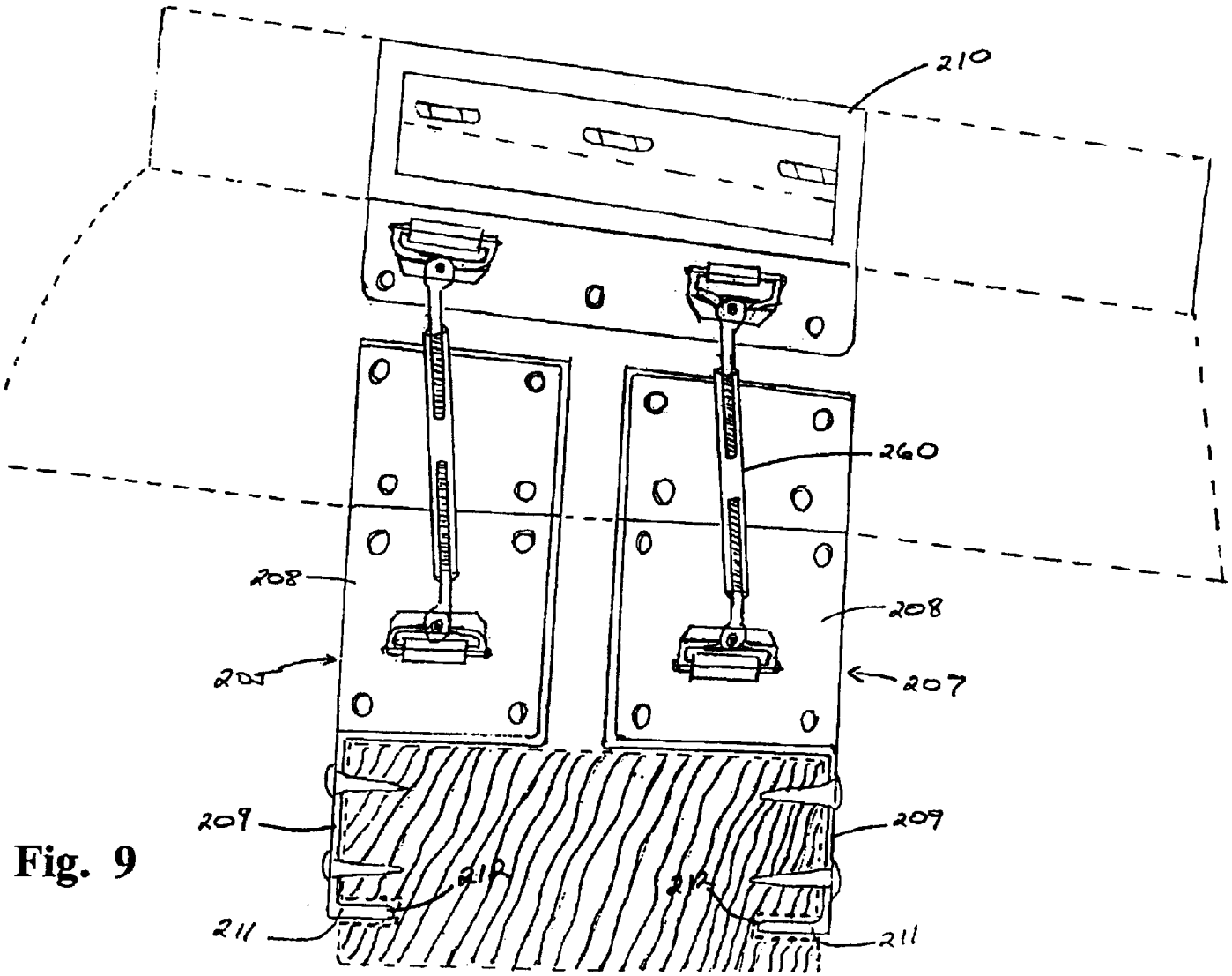
FIG. 9 shows an end view of the roof tie of FIG. 6.

Tie components 205, 207 present mirror images of each other. Such tie component 205, 207 are of similar construction as described with reference to FIGS. 1 and 2. Referring to FIG. 9, the C-shaped lower portion of tie components 205, 207 comprises fastener extension 208, a top plate flap 209 with an appendage 211. Appendage 211 extends inwardly at a right angle from top plate flap 209. Top plate flap 209 is sized and configured such that appendage 211 can fit under a top plate to form a three-sided wrap with fastener extension 208 and top plate flap 209. In some embodiments, and as particularly shown in FIG. 9, top plate flap 209 is sized and configured such that appendage 211 may be embedded into a side of the top plate. In such an embodiment, appendage 211 should penetrate approximately ¾-inch into the wood top plate; the inner edge 212 of appendage 211 may be sharpened to enable such penetration.

Figure 10:
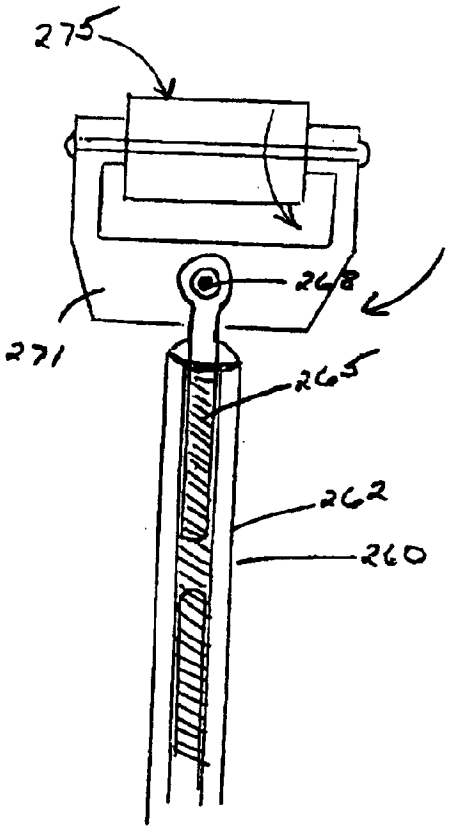
FIG. 10 shows a close-up view of a portion of FIG. 6.
Figure 6:
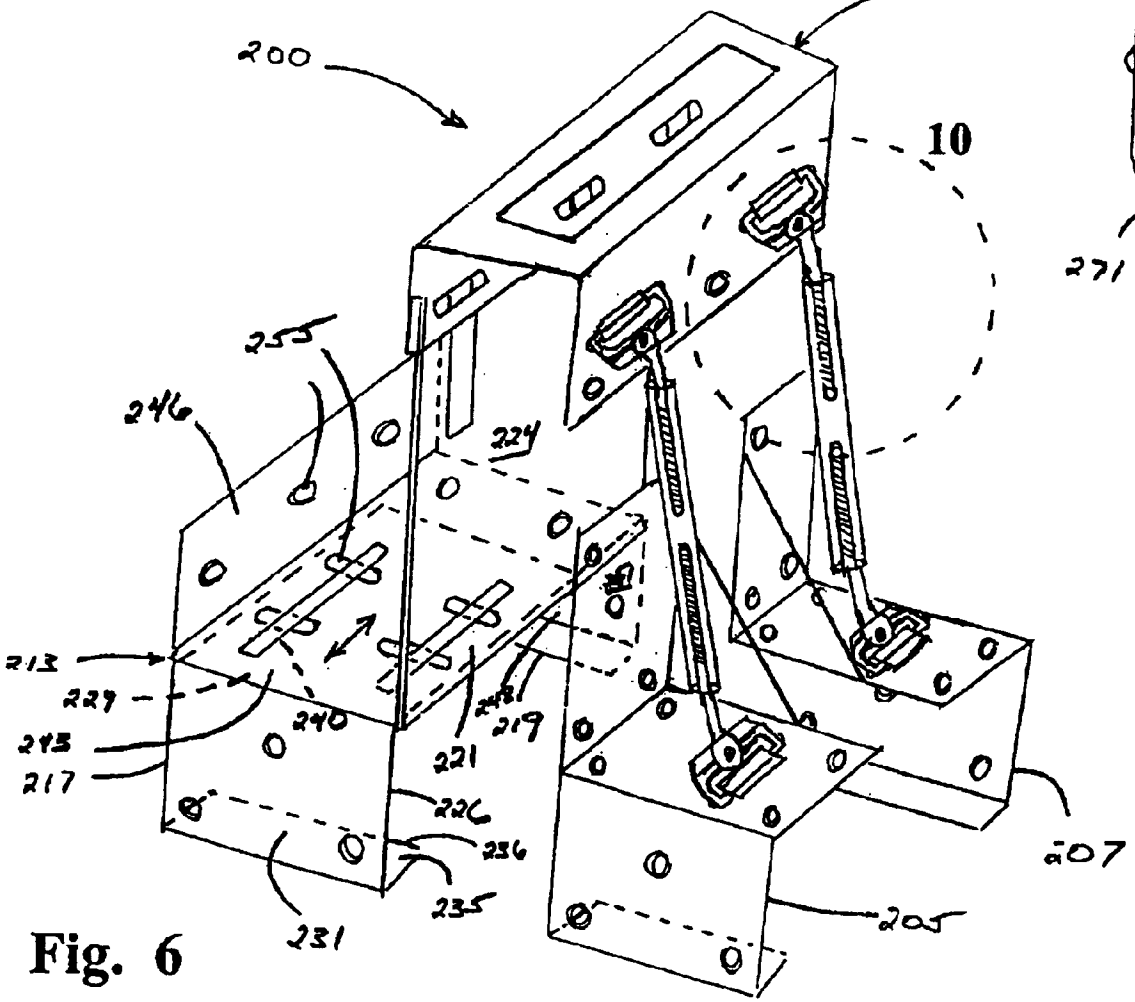
FIGS. 6 and 7 show an illustration of the roof tie in perspective, according to an additional alternate embodiment of the present invention.
Figure 7:
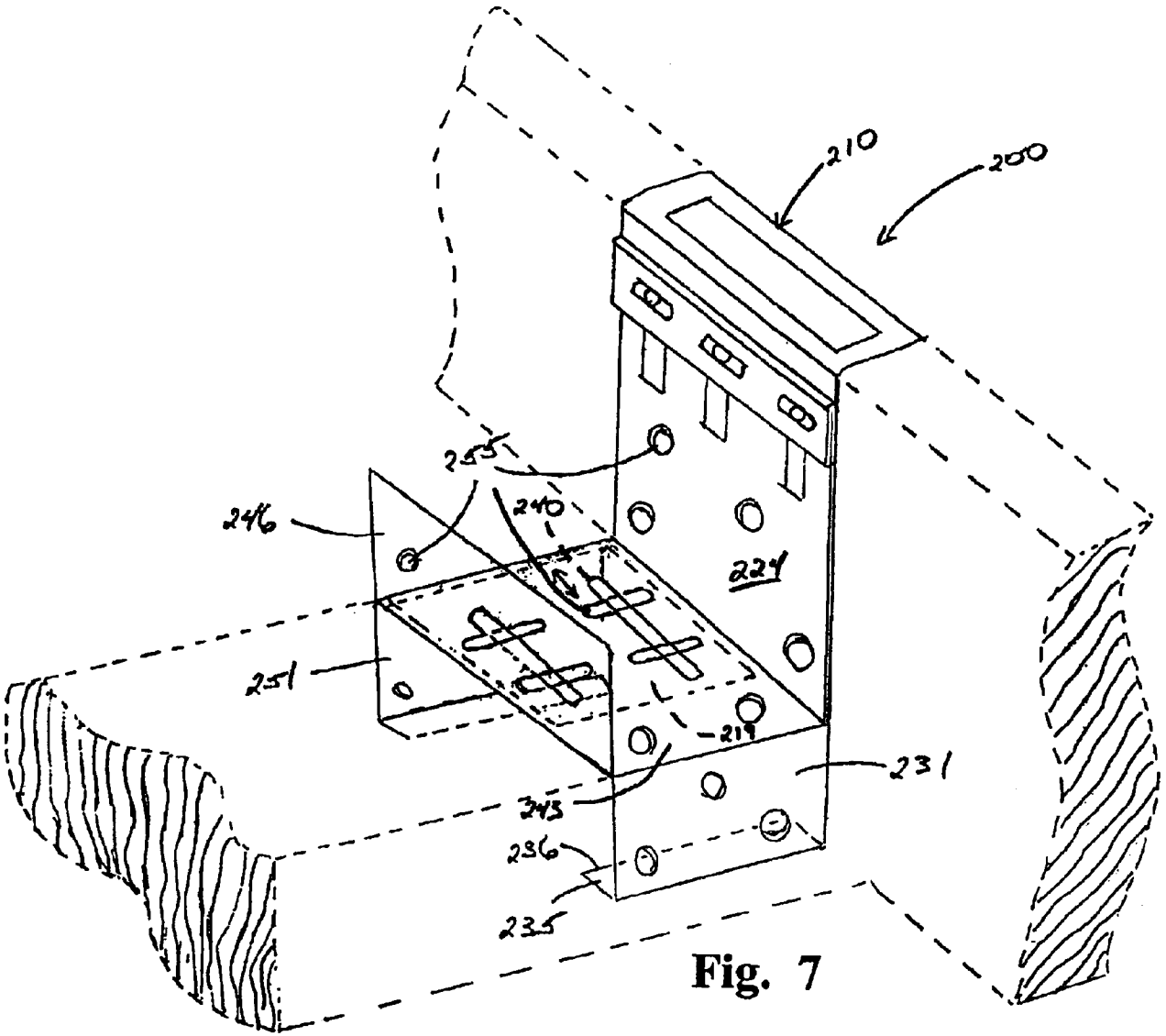

Referring to FIG. 10, each tie component 205, 207 is connected to bridge component 210 by a turnbuckle 260. Turnbuckle 260 comprises body 262 having a pair of threaded portions 265 extending out of the top and bottom of body 262. Body 262 is internally threaded for mating with such threaded portions 265. The alignment of the threads of such threaded portions 265 is configured such that rotation of body 262 in a first direction about its longitudinal axis causes both such threaded portions 265 to be drawn into body 262 and rotation of body 262 in a second, opposite direction about its longitudinal axis causes both such threaded portions 265 to be forced out of body 262. The outer end of each such threaded portion 265 forms a pivotable attachment 268 to a hinge plate 271. Hinge plate 271 is hingedly attached to bridge component 210 and tie component 205, 207 by a hinge and pin assembly 275.

Figure 11:
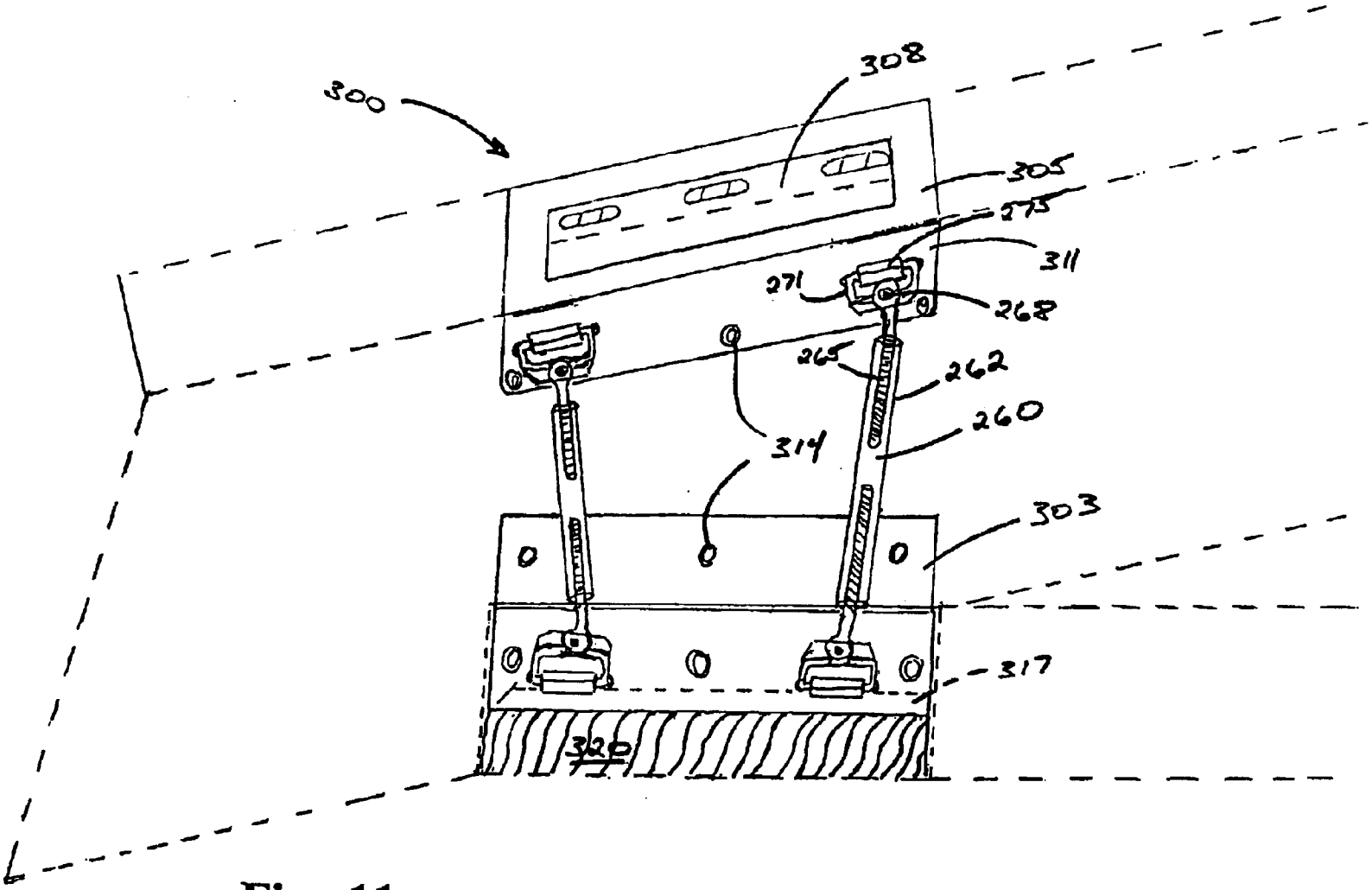
FIG. 11 shows an illustration of a gable end roof tie according to the present invention.

The backside of a gable end roof tie 300 is shown in FIG. 11. The front side of such gable end roof tie 300 is similar to the roof tie shown and described with reference to FIG. 3. In some embodiments, such front side will not include short wall 43. The remaining portion of gable end roof tie 300 comprises a tie plate 303 and a bridge component 305 having a wide aperture area 308 to permit fastening decking to a rafter. Such bridge component 305 should be wide enough to conform to the standard thickness of construction materials, such as wooden 2×4s. Bridge component 305 comprises a short riser 311 having a plurality of apertures 314 for fastening such bridge component 305 to a rafter.

Tie plate 303 includes an appendage 317 that extends inwardly at a right angle from tie plate 303. Appendage 317 may be embedded into the butt end of top plate 320. The inner edge of appendage 317 may be sharpened to enable penetration into top plate 320. A plurality of apertures 314 for inserting fasteners, such as nails is disposed on tie plate 303. Tie plate 303 is connected to bridge component 305 by at least one turnbuckle 260. Turnbuckle 260 comprises body 262 having a pair of threaded portions 265 extending out of the top and bottom of body 262. Body 262 is internally threaded for mating with such threaded portions 265. The alignment of the threads of such threaded portions 265 is configured such that rotation of body 262 in a first direction about its longitudinal axis causes both such threaded portions 265 to be drawn into body 262 and rotation of body 262 in a second, opposite direction about its longitudinal axis causes both such threaded portions 265 to be forced out of body 262. The outer end of each such threaded portion 265 forms a pivotable attachment 268 to hinge plate 271. Hinge plate 271 is hingedly attached to the short riser 311 of bridge component 305 and tie plate 303 by a hinge and pin assembly 275. As shown, the turnbuckles can be adjusted up or down, forward or backwards to enable bridge component 305 to conform to a pitched roof and provide sufficient hold down tension.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A roof tie for connecting wood members in building structures, comprising:

a. a first connector, comprising:

(1) a first substantially horizontal member having a forward edge, a rear edge, an inside edge, and an outside edge;

(2) a first flap fixedly connected and extending downwardly at right angles from said forward edge of said first horizontal member;

(3) a second flap hingedly connected and extending downwardly at right angles from said rear edge of said first horizontal member; and (4) a first riser extending substantially vertical at a right angle from said inside edge of said first horizontal member;

b. a bridge component, comprising:

(1) a substantially horizontal crosspiece member;

(2) a short riser on a first side of said crosspiece member substantially perpendicular to said crosspiece member, wherein said short riser is shorter than said first riser of said first connector; and (3) an overlap plate on a second side of said crosspiece member substantially perpendicular to said crosspiece member; wherein said overlap plate is pierced by at least one aperture and said first riser is pierced by at least one slot for inserting a fastener therethrough, such that said at least one aperture on said overlap plate can align with said at least one slot on said first riser when said overlap plate overlaps said first riser;

c. a second connector, comprising:

(1) a second substantially horizontal member having a forward edge, a rear edge, an inside edge, and an outside edge;

(2) a flap extending downwardly at right angles from said forward edge of said second horizontal member;

(3) a wall extending substantially vertical at a right angle from said inside edge of said second horizontal member, and (4) a turnbuckle having a body, a first threaded portion, and a second threaded portion, wherein i. said first threaded portion being attached to said short riser of said bridge component; and ii. said second threaded portion being attached to said second horizontal member;

d. a third connector, comprising:

(1) a third substantially horizontal member having a forward edge, a rear edge, an inside edge, and an outside edge;

(2) a flap extending downwardly at right angles from said rear edge of said third horizontal member;

(3) a wall extending substantially vertical at a right angle from said inside edge of said third horizontal member, and (4) a turnbuckle having a body, a first threaded portion, and a second threaded portion, wherein i. said first threaded portion being attached to said short riser of said bridge component; and ii. said second threaded portion being attached to said third horizontal member; and e. said first connector, second connector, third connector, and said bridge component being adapted for attaching said roof tie to a first roofing member and a second roofing member.

2. The roof tie according to claim 1, further comprising:

means for attaching roof decking to said second roofing member through said bridge component.

3. The roof tie according to claim 2 wherein said means for attaching roof decking to said second roofing member through said bridge component comprises a wide aperture area.

4. The roof tie according to claim 1 wherein said overlap plate is disposed away from said crosspiece member by a ledge.

5. The roof tie according to claim 1, said first connector further comprising:

a wall extending upwardly at a right angle from said outside edge of said first horizontal member.

6. The roof tie according to claim 5 wherein said wall is shorter than said first riser of said first connector.

7. The roof tie according to claim 1, further comprising:

a. said first riser having a forward edge and a rear edge, wherein said forward edge is longer than said rear edge; and b. said bridge component is angled corresponding to a predetermined roof pitch.

8. The roof tie according to claim 1, said second connector further comprising:

a wing member extending from the rear edge of said wall and connected to said second horizontal member along said rear edge of said second horizontal member.

9. The roof tie according to claim 1, said third connector further comprising:

a wing member extending from the rear edge of said wall and connected to said third horizontal member along said rear edge of said third horizontal member.

10. The roof tie according to claim 1, said first connector further comprising:

an appendage extending substantially perpendicular from the bottom edge of said first flap.

11. The roof tie according to claim 10 wherein said appendage presents a sharpened edge configured to penetrate into said first roofing member.

12. The roof tie according to claim 1, said second connector further comprising:

an appendage extending substantially perpendicular from the bottom edge of said flap.

13. The roof tie according to claim 12 wherein said appendage presents a sharpened edge configured to penetrate into said first roofing member.

14. The roof tie according to claim 1, said third connector further comprising:

an appendage extending substantially perpendicular from the bottom edge of said flap.

15. The roof tie according to claim 14 wherein said appendage presents a sharpened edge configured to penetrate into said first roofing member.

* * * * *